US005189993A

United States Patent [19]

Schneider

[11] Patent Number: 5,189,993

[45] Date of Patent: Mar. 2, 1993

[54] IN-LINE THREE CYLINDER COMBUSTION ENGINE

[76] Inventor: Wallace Schneider, 41 W. 72nd St., New York, N.Y. 10023

[21] Appl. No.: 720,950

[22] Filed: Jun. 25, 1991

[51] Int. Cl.[5] ..... F02B 75/06

[52] U.S. Cl. ..... 123/53 A; 123/192.2

[58] Field of Search ..... 123/192.1, 192.2, 59 R, 123/59 A, 59 B, 53 R, 53 A, 53 B

[56] References Cited

U.S. PATENT DOCUMENTS

| | | | |
|---|---|---|---|
| 1,410,019 | 3/1922 | Krause . | |
| 2,117,700 | 5/1938 | Burkhardt . | |
| 2,974,541 | 3/1961 | Dolza . | |
| 3,402,707 | 9/1968 | Heron . | |
| 3,474,768 | 10/1969 | Anesetti . | |
| 3,626,815 | 12/1971 | Fingeroot et al. | 123/192 B |
| 3,859,966 | 1/1975 | Braun | 123/192 R |
| 3,874,358 | 4/1975 | Crower | 123/192 B |
| 4,300,493 | 11/1981 | Berti | 123/192 B |
| 4,331,111 | 5/1982 | Bennett | 123/192 R |
| 4,565,169 | 1/1986 | Suzuki | 123/192 B |
| 4,569,316 | 2/1986 | Suzuki | 123/192 R |
| 4,659,777 | 4/1987 | Suzuki | 123/192 B |
| 4,940,026 | 7/1990 | Fisher | 123/192 B |

FOREIGN PATENT DOCUMENTS

| | | | |
|---|---|---|---|
| 3120190 | 5/1982 | Fed. Rep. of Germany . | |
| 0124844 | 7/1983 | Japan | 123/192.2 |

*Primary Examiner*—David A. Okonsky
*Attorney, Agent, or Firm*—Darby & Darby

[57] ABSTRACT

An internal combustion engine of the in-line type which has sets of cylinders in which a full-sized chamber is aligned between a pair of half-sized power chambers. Sets of pistons movable in corresponding ones of the cylinders define the chambers within the cylinders respectively. Pistons are connected to a crankshaft so that the pistons which define the half-sized power chambers move together in unison in a direction which is opposite to that which the piston which defines the full-sized chamber moves. Each half-sized chamber defines a volumetric displacement which is substantially one half that of the full-sized chamber.

16 Claims, 2 Drawing Sheets

IN-LINE THREE CYLINDER COMBUSTION ENGINE

BACKGROUND OF THE INVENTION

Cross-Reference to Disclosure Document

This application is based on disclosure document No. 249084, received Apr. 9, 1990 by the U.S. Pat. and Trademark Office.

FIELD OF THE INVENTION

The present invention relates to a three cylinder combustion engine in which the piston cylinders are arranged in-line with each other.

DISCUSSION OF RELATED ART

Three cylinder combustion engines are known, but they do not lend themselves readily for alignment of the cylinders in-line because the driving of their pistons creates unbalanced vibration at one end of an engine block. Such unbalanced vibration may arise where each of the pistons are identical in size and the cylinder combustion chambers are fired either simultaneously or successively. Therefore, it has become necessary to employ contra-rotating balance shafts with each piston to offset such imbalanced vibration. U.S. Pat. No. 4,658,777 is illustrative of this concept of providing contra-rotating balance shafts. With an in-line design, the size of the engine is smaller than would otherwise be the case if the cylinders were arranged in V-line instead.

U.S. Pat. No. 4,940,026, whose contents are incorporated herein by reference, provides for an internal combustion engine design in which two outer piston and cylinder assemblies are located in directly opposed relation to a central piston and cylinder assembly. Counterweights are not employed. Vibration is significantly reduced or eliminated even though the size and/or number of the specifically structured piston and cylinder assemblies may vary. In addition to the opposed relationship of the piston and cylinder assemblies, the volumetric displacement of each of two outer pistons is one half that of the central larger piston, which enables the delivery of a balanced power stroke that is substantially vibration free.

However, U.S. Pat. No. 4,940,026 does not suggest any application to an in-line cylinder arrangement; rather the piston and cylinder assemblies are arranged in opposed relation and are simultaneously fired in order to provide for this balanced power stroke which is essentially vibration free. Further, such an arrangement requires a larger size engine than would be otherwise the case for an in-line cylinder type engine.

It is therefore desired to provide an in-line cylinder engine design which is essentially vibration free and does not employ counterweights, additional shafts or gearing to effect desired smoothness.

SUMMARY OF THE INVENTION

The present invention is directed to an internal combustion engine of the in line cylinder type that includes a crankshaft and at least one set of pistons which are in line with each other. The pistons deliver successive power strokes to impart rotary motion to the crankshaft as the pistons displace linearly in respective cylinders. All of the pistons and cylinders extend from the same side of the crankshaft.

Two outer piston and cylinder assemblies each define respective half-sized chambers. A central piston and cylinder assembly defines a full-sized chamber and is located between the two outer cylinders. Each piston displaces within the respective chamber. These chambers may be considered power or combustion chambers because a fuel/air mixture is to be combusted at the end of each piston's compression stroke inside the associated chamber. After combustion, the pistons each effect a power stroke. The two outer pistons move together in unison in a direction which is opposite to that which the central piston moves at any given time.

The volume of fuel/air mixture in the full-sized chamber displaced or swept by the central piston during its compression stroke is twice that displaced or swept in each of the half-sized chambers by each respective one of the outer two pistons. The central cylinder is more massive than the outer pistons and has a longer power stroke and crank throw so that when the fuel/air :mixtures in the half-sized chambers are combusted at the same time to commence simultaneous power strokes, the ensuing inertial forces imparted by the outer pistons during the power strokes are counterbalanced by the extra mass of the central piston, piston rod and connecting crank linkage portion during the central piston's compression stroke. Similarly, as the power stroke of the central piston takes place in the center of the engine block, the ensuing inertial forces and vibrations induced by this power stroke is counter-balanced by inertial forces and vibrations induced by simultaneous compression strokes from the outer pistons.

BRIEF DESCRIPTION OF THE DRAWING

For a better understanding of the present invention, reference is made to the following description and accompanying drawing while the scope of the invention will be pointed out in the appended claims.

DESCRIPTION OF THE PREFERRED EMBODIMENT

Figure 1:
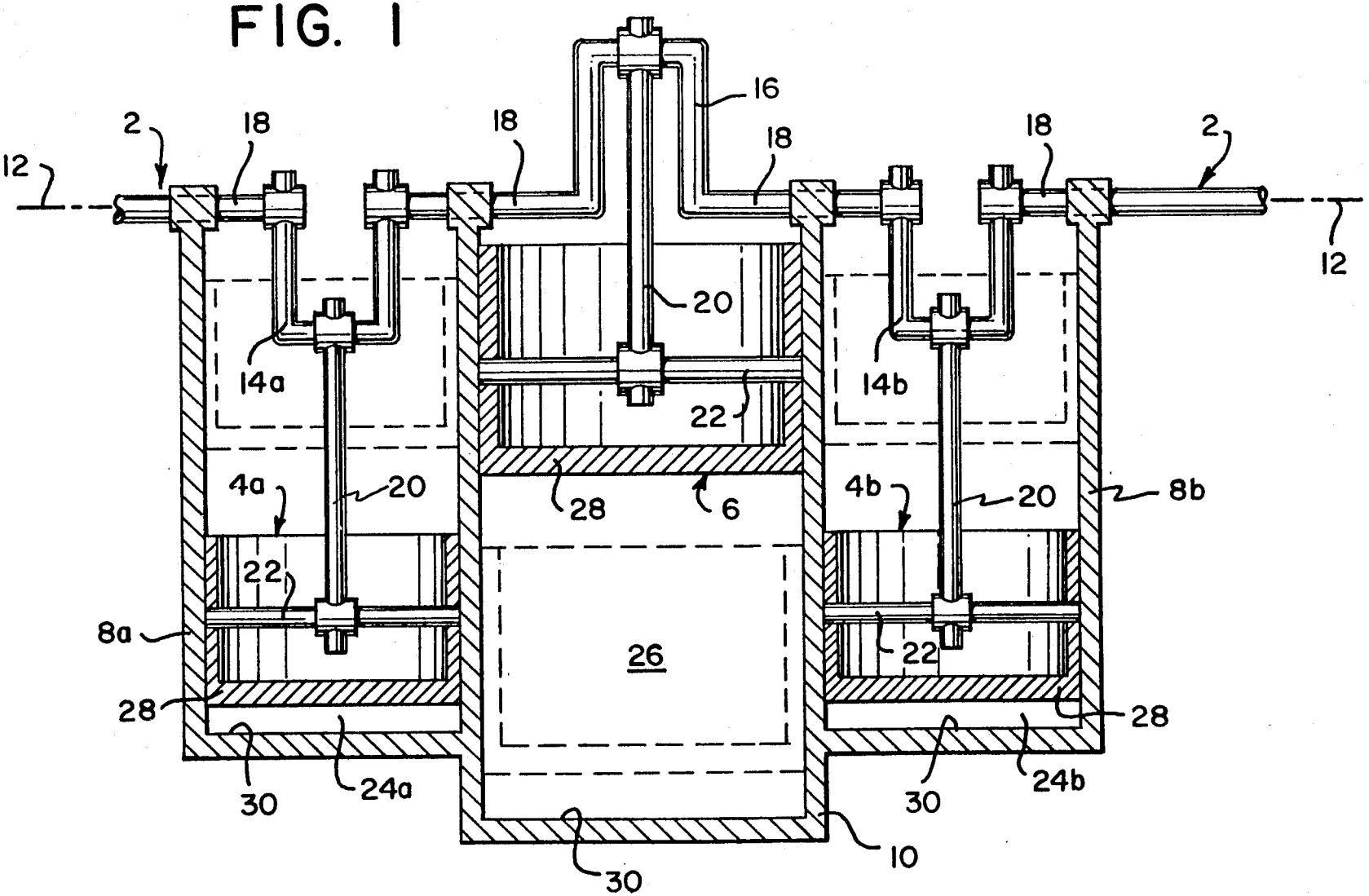
FIG. 1 shows a longitudinal cross-sectional schematic view of an embodiment of the present invention.
Figure 2:
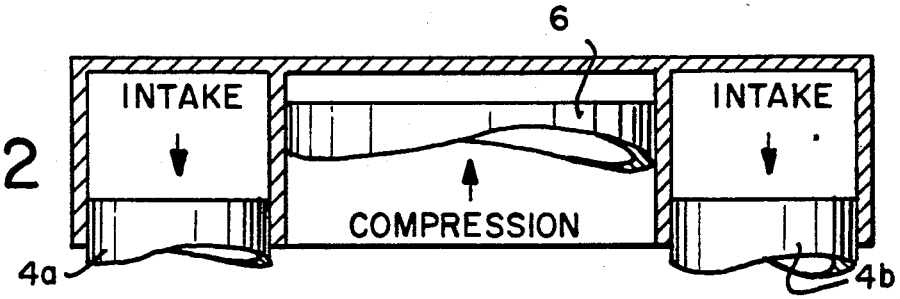
FIGS. 2–5 show schematic illustrations, respectively, of a first, a second, a third and a fourth cycle of a four-stroke combustion engine in accordance with an embodiment of the present invention.
Figure 3:
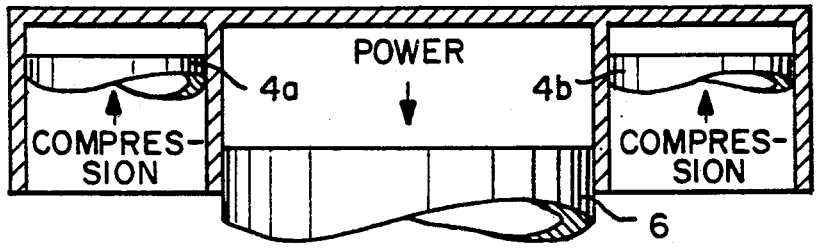
Figure 4:
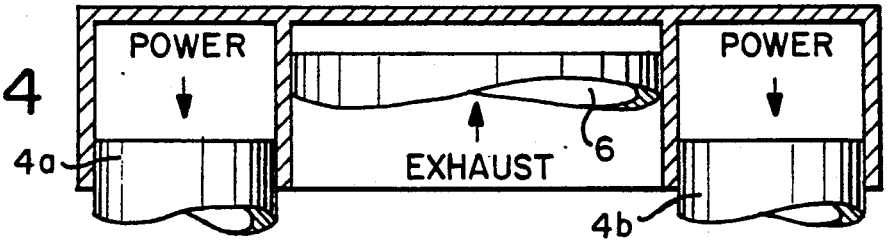
Figure 5:
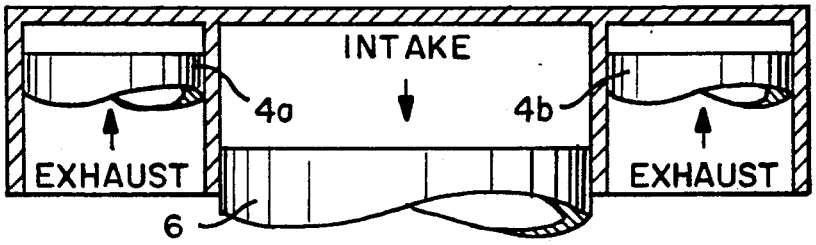

FIG. 1 shows a common crankshaft 2, two outer pistons 4*a*, 4*b*, a central piston 6 between the outer pistons 4*a*, 4*b*, two outer cylinders 8*a*, 8*b*, and a central cylinder 10. The crankshaft is rotatable about an axis 12. The cylinders are integrally formed together as a single piece construction. The outer pistons 4*a*, 4*b* displace within the respective outer cylinder 8*a*, 8*b* by moving in parallel to each other because of their linkage to the crankshaft 2. The central piston 6 displaces within the central cylinder 10, but its linkage to the crankshaft is offset by 180 degrees with respect to that for the outer pistons so that it moves opposite to the direction in which the outer pistons move at any given time.

As shown in the drawing, a power transmission system is provided which converts the back and forth motion of the pistons within the cylinders during the power strokes into rotary motion of the crankshaft 2. Conversely, the transmission system imparts the rotary motion of the crankshaft into linear motion of the pistons within the cylinders during their compression strokes.

This transmission system includes two outer U-shaped crank linkage portions 14*a*, 14*b*, a central U-shaped crank linkage portion 16 which is between and offset by 180 degrees from the two outer U-shaped crank linkage portions, shaft portions 18 which interconnect the U-shaped crank linkage portions, and connecting rods 20 whose two ends rotatably connect with the base of a respective U-shaped crank linkage portion and a transversely extending piston support rod 22 in a known manner. This linkage of each connecting rod 20 to the corresponding U-shaped crank portion enables the crankshaft 2 to rotate about the axis 12 with respect to each of the connecting rods 20. Each cylinder has an open end rotatably attached to a respective shaft portion 18 of the crankshaft 2 so that the crankshaft 2 is rotatable with respect to the cylinders as well.

Each piston 4*a*, 4*b*, 6 is movable within its corresponding cylinder 8*a*, 8*b*, 10 for displacing the volume of a respective chamber 24*a*, 24*b*, 26. Each chamber is defined between a front surface of the respective piston head 28 and the closed end inside surface 30 of the respective cylinder which face each other. Each of the cylinders 8*a*, 8*b*, 10 and thereby each of the chambers 24*a*, 24*b*, 26 are in line with each other on the same side of the crankshaft 2. The cylinders 8*a*, 8*b*, 10, pistons 4*a*, 4*b*, 6 are shown in cross-section with each having a square shape or each having a circular shape, although other symmetric geometric shapes are suitable as well.

Although FIG. 1 does not show a seal between the pistons and the cylinder walls, such a seal is present and is well known. Such a seal is capable of withstanding the temperatures and pressures expected within the cylinder during ignition in the chamber so as to keep the chamber sealed against leakage of the fuel/air mixture contained in the chamber. The seal may be formed on the exterior of the sidewalls of the piston head 28 or else line the side walls of each cylinder.

The chambers 24*a*, 24*b* are half-size chambers and the chamber 26 is a full-size chamber insofar as the volume displacement of the full-size chamber is about twice that of each of the half-size chambers. Together, the power strokes in each of the half-size chambers will about equal the power stroke in the full-size chamber.

Provision is made (not shown) in a known manner for igniting the fuel/air mixture within each chamber at the end of the compression stroke of the corresponding piston in order to thereafter commence the power stroke. Further, supply ports (not shown) are provided for introducing the fuel and air into the chamber after ignition and an exhaust port may be provided for suctioning out ignited residual gases.

Preferably, the volume of the air-fuel mixture swept by the central piston 6 within the central cylinder 10 is about twice that swept by each of the outer pistons 4*a*, 4*b* within the respective outer cylinders 8*a*, 8*b*. For instance, the volume swept by the central piston 6 may be 125 cubic units while the volume swept by each of the outer pistons 4*a*, 4*b* may be 64 cubic units when the "bore and stroke" ratio of the central piston 6 to each outer piston 4*a*, 4*b* is 5:4 (i.e., the cube of 5:4 is 125:64). The crank throw ratio would also be 5:4 for the central piston with respect to each outer piston. The outer pistons 4*a*, 4*b* should each sweep with the same overall compression ratio as the central piston.

The central piston 6 sweeps twice the volume as that swept by each of the outer pistons 4*a*, 4*b*. In this manner, the volumetric displacement of each half-size chamber 24*a*, 24*b* is about one-half that of the full-size chamber 26.

If desired, the stroke length and diametrical area of each cylinder/piston assembly may be varied as long as the central piston displaces about twice the volume displacement of that displaced by each of the outer cylinders. For instance, if the diametrical area of the cylinders remained the same, the stroke length of the central piston may be further increased twice as much as the increase for each of the outer pistons. Conversely, if the stroke lengths remained the same, the transverse diametrical area of the central piston may be increased by 1.414 times as much as the increase for each of the outer pistons and still maintain the proper volumetric displacements.

The central piston 6 will be handling twice the power during its power stroke as compared to that handled by either of the outer pistons 4*a*, 4*b* individually. Thus, the central piston 6 should be of a more massive construction so that the extra mass of the central piston, piston rod and U-shaped crank linkage portion in view of the longer stroke and throw of the central piston 6 should, with minor weight adjustments, counterbalance the inertial forces of the outer pistons 4*a*, 4*b* acting together.

FIGS. 2–5 are illustrations of an embodiment of a four-stroke cycle of the engine in which four strokes occur in succession. In the first cycle of FIG. 2, the central piston 6 moves up for effecting a compression stroke while the two outer pistons 4*a*, 4*b* move down for effecting an intake stroke. In the second cycle of FIG. 3, the central piston 6 moves down for effecting a power stroke while the two outer pistons 4*a*, 4*b*move up for effecting a compression stroke. In the third cycle of FIG. 4, the central piston 6 moves up for effecting an exhaust stroke while the two outer pistons 4*a*, 4*b* move down for effecting a power stroke. In the fourth cycle of FIG. 5, the central piston 6 moves down for effecting an intake stroke while the two outer pistons 4*a*, 4*b* move up for effecting an exhaust stroke. After the fourth cycle, the sequence is repeated for the first to fourth cycles.

The four stroke cycle diagram of FIGS. 2–5 is presented as an example and is not to be construed as being limited to the sequence depicted. As far as balancing is concerned, it makes no difference how the cycling proceeds since the inertial masses and forces remain the same whether a given piston is moving for effecting a compression stroke or for effecting an exhaust stroke. Although the power strokes of the outer pistons are shown following that of the central piston, the sequence may be instead that the power stroke of the central piston follows that of the outer pistons. The application of power, however, is smoother where the power strokes do not directly follow each other.

Preferably, the central piston 6 is located in the center of the engine block so that its power stroke is at the center of the engine block mass. Since the outer pistons 4*a*, 4*b* move during their compression strokes in the opposite direction in response to the power or exhaust stroke by the central piston, the inertial forces of the outer pistons lessen the imbalance and vibration from the central piston which would otherwise be left unchecked at the center of the engine block. Similarly, the imbalance and vibration from the outer pistons 4*a*, 4*b* whose simultaneous power strokes are directed at the outer ends of the engine block during their simultaneous power strokes are lessened by the central piston 6 moving in response during its compression or exhaust stroke in the opposite direction.

It is preferred that the two outer pistons be equal to each other in weight and configuration and lined through the crankshaft to move in parallel with each other so that their simultaneous power strokes will, in their turn, equal the power stroke of the central piston.

The crankshaft of the three cylinder engines of the present invention may be shorter and stiffer than that for four, five or six cylinder engines because of the counterbalancing, which enables closer tolerances in manufacturing. A three cylinder engine is cheaper and less complicated to manufacture than a four, five or six cylinder engine.

The three cylinder in line design of the present invention has application in a traditional four-stroke gasoline engine (as in FIGS. 2–5) and will work well with other combustible fuels besides gasoline.

The three cylinder in-line design of the present invention may be employed in a two-stroke engine (as in FIGS. 6–7), or in a stratified-charge engine. In the highly advantageous pattern of the two-stroke engine, the central cylinder would fire on the intake-compression stroke of the two outer cylinders and they would then fire on the intake-compression stroke of the central cylinder, achieving a perfectly even and balanced flow of power during the resulting exhaust-power stroke. No dynamic counterweight balancing is needed.

Figure 6:
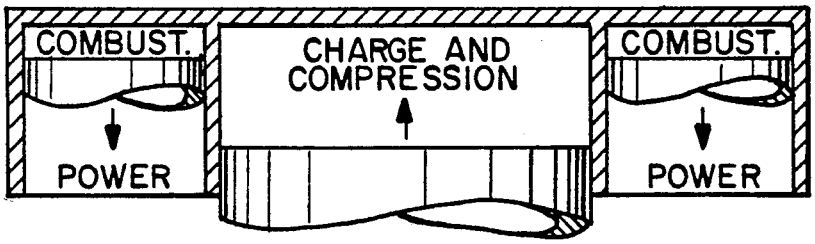
FIGS. 6 and 7 show schematic illustrations, respectively, of a first and a second cycle of a two-stroke combustion engine in accordance with another embodiment of the present invention.
Figure 7:
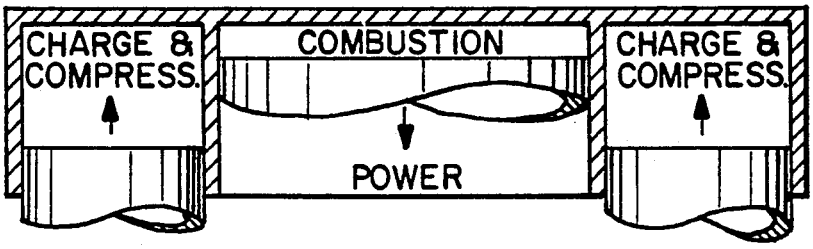

FIG. 6 shows a first cycle, where combustion in the two outer cylinders causes the two outer cylinders to effect simultaneous power strokes. In response, the central position effects a compression stroke and the central cylinder chamber charges with cumbustible fuel. FIG. 7 shows a second cycle, where combustion in the central cylinder causes the central piston to effect a power stroke. In response, the two outer pistons simultaneously effect a compression stroke and the outer cylinder chambers charge with combustible fuel.

Each embodiment of the invention is applicable to an equivalent arrangement in which either or both of the outer piston and cylinder assemblies and/or the central piston and cylinder assembly are replaced by a respective set of two or more piston and cylinder assemblies of smaller size, which, when taken together, are the equivalent to the outer or central piston and cylinder assembly which they replace. The outer two sets move in unison and in parallel with each other while the central set moves together in a direction opposite to that of the outer two sets at any given time. Thus, the inertial forces created by the outer sets would be counterbalanced by the central set in the same manner and vice versa.

While the foregoing description and drawings represent the preferred embodiments of the present invention, it will be understood that various changes and modifications may be made without departing from the spirit and scope of the present invention.

What is claimed is:

1. An internal combustion engine of the in-line type, comprising:

a set of cylinders in which is contained a full-sized chamber and a pair of half-sized chambers so that said full-sized chamber is aligned between said pair of half-sized chambers, each of said half-sized chambers having a volumetric displacement which is substantially one-half that of said full-size chamber;

two outer pistons movable in corresponding ones of said cylinders for defining said half-sized chambers;

a central piston movable in another of said cylinders for defining said full-sized chamber; and a rotatable crankshaft to which is connected each of said pistons so that said outer pistons move together in unison in a direction which is opposite to that which said central piston moves at the same time, all of said pistons and cylinders extending from the same side of said crankshaft, whereby inertial forces and vibrations induced from simultaneous power strokes by said outer pistons are lessened by inertial forces and vibrations induced by said central piston moving opposite that of said outer pistons in response to the simultaneous power strokes and whereby inertial forces and vibrations induced from a power stroke by said central piston are lessened by inertial forces and vibrations induced by said outer pistons moving opposite that of said central piston simultaneously in response thereto.

2. An engine as in claim 1, wherein said half-sized chambers are symmetrically arranged on either side of said full-sized chamber with respect to each other.

3. An engine as in claim 1, wherein each of said pistons is connected to said crankshaft via a respective connecting rod and U-shaped crank portion, each of said cylinders, outer pistons, respective connecting rods and respective U-shaped crank portions constituting a respective outer assemblage which has a respective combined weight, said combined weight being approximately one-half a combined weight of said central cylinder, central piston, respective connecting rod and respective U-shaped crank portion.

4. An engine as in claim 1, wherein each of said half-sized power chambers and said full-sized chamber are elongated to have a length which is equal to each other.

5. An engine as in claim 1, wherein each of said half-sized power chambers and said full-sized chamber define a diameter which is equal to each other.

6. An engine as in claim 1, wherein each of said cylinders are arranged side-by-side with a first wall separating said full-sized chamber from one of said half-sized chambers and a second wall separating said full-sized chamber from the other of said half-sized chambers, each of said walls having a face which defines a portion of said full-sized power chamber and having an opposite face which defines a portion of a respective one of said half-sized power chambers.

7. An engine as in claim 1, wherein said crankshaft and each of said cylinders are connected together so that said crankshaft is rotatable with respect to each of said cylinders.

8. An engine as in claim 1, further comprising means for cycling said pistons to effect a two stroke cycle which comprises strokes for effecting combustion and power, said combustion stroke of said central piston being effected in response to power strokes of said outer pistons, said combustion strokes of said outer pistons being effected in response to a power stroke of said central piston.

9. An engine as in claim 1, further comprising means for cycling said pistons to effect a four stroke cycle which comprises strokes for effecting intake, compression, power and exhaust in succession.

10. A method of operation of an internal combustion engine of the in-line type which has a set of pistons and has a set of cylinders in which is contained a full-sized chamber and a pair of half-sized chambers that are arranged so that the full-sized chamber is aligned between the pair of half-sized chambers, each of the half-sized chambers having a volumetric displacement which is substantially one-half that of the full-sized chamber, two outer ones of the pistons being linearly movable to define the pair of half-sized chambers, respectively, and a central one of the pistons being linearly movable to define the full-sized chamber, all of the pistons and cylinders extending from the same side of a crankshaft, the method comprising the steps of:

effecting simultaneous power strokes caused by linear movement of the two outer pistons simultaneously in the same direction in response to simultaneous combustion within each of the half-sized chambers;

converting the linear movement of the outer pistons into rotary motion of the crankshaft in response to the simultaneous power strokes;

converting rotary motion of the crankshaft into linear movement of a central piston by which the central piston moves in a direction opposite to that which said outer pistons move during the simultaneous power strokes;

effecting a central power stroke caused by linear movement of the central piston in response to combustion in the full-sized chamber;

converting the linear movement of the central piston into rotary motion of the crankshaft in response to the central power stroke;

converting rotary motion of the crankshaft into linear movement of each of the outer pistons simultaneously in response to the central power stroke so that the outer pistons each move in a direction opposite to that which the central piston moves during the central power stroke; and thereby lessening inertial forces and vibrations induced by the simultaneous power strokes from the outer pistons with inertial forces and vibrations induced from the central piston moving in response to said simultaneous power strokes and also lessening inertial forces and vibrations induced by the central power stroke from the central piston with inertial forces and vibrations induced from the outer pistons moving in response to said central power stroke.

11. A method as in claim 10, further comprising the steps of effecting a compression stroke with the central piston in response to the simultaneous power strokes being effected; and effecting a simultaneous compression stroke with the outer pistons simultaneously in response to the central power stroke being effected so that the internal combustion engine has a two stroke cycle which comprises strokes of compression and power.

12. A method as in claim 10, further comprising the step of cycling the pistons to effect a two stroke cycle which comprises strokes of compression and power, said compression stroke of said central piston being effected in response to said power strokes of said outer pistons, said compression strokes of said outer pistons being effected in response to a power stroke of said central piston.

13. A method as in claim 10, further comprising the step of cycling the pistons to effect a four stroke cycle which comprises strokes of intake, compression, power and exhaust in succession.

14. An internal combustion engine of the in line type, comprising:

a set of pistons;

a set of cylinders in which is contained a full-sized chamber and a pair of half-sized chambers that are arranged so that said full-sized chamber is aligned between said pair of half-sized chambers, each of said half-sized chambers having a volumetric displacement which is substantially one-half that of said full-sized chamber, an outer two of said pistons being linearly movable to define said half-sized chambers, respectively, a central one of said pistons being linearly movable to define said full-sized chamber, all of said pistons and cylinders extending from the same side of a crankshaft, said two outer pistons being responsive to combustion within each of said half-sized chambers at the same time for effecting simultaneous power strokes by moving linearly simultaneously in the same direction; and transmission means responsive to said simultaneous power strokes for converting linear movement of said outer pistons into rotary motion of said crankshaft and for converting rotary motion of said crankshaft into linear movement of said central piston in a direction opposite to said same direction, said transmission means also being for converting linear movement of said central piston into rotary motion of said crankshaft in response to said central piston effecting a central power stroke by which said central piston moves linearly because of combustion in said full-sized chamber and for converting rotary motion of said crankshaft into linear movement of each of said outer pistons simultaneously in response to said central power stroke so that said outer pistons each move in a direction opposite to that which said central piston moves;

whereby inertial forces and vibrations induced by the simultaneous power strokes from said outer pistons are lessened by inertial forces and vibrations induced from the central piston moving in response to the simultaneous power strokes and whereby inertial forces and vibrations induced by the central power stroke from said central piston is lessened by inertial forces and vibrations induced from said outer pistons moving in response to the central power stroke.

15. An engine as in claim 14, further comprising means for effecting a two stroke cycle which comprises strokes of compression and power with the pistons so that the compression stroke of the central piston takes place in response to the simultaneous power strokes taking place and so that simultaneous compression strokes of the outer pistons take place in response to the central power stroke taking place.

16. An engine as in claim 14, further comprising means for effecting a four stroke cycle which comprises strokes of intake, compression, power and exhaust strokes with the pistons.

* * * * *